US007900850B2

(12) United States Patent
Zengerle et al.

(10) Patent No.: US 7,900,850 B2
(45) Date of Patent: Mar. 8, 2011

(54) MICRODOSING APPARATUS AND METHOD FOR DOSED DISPENSING OF LIQUIDS

(76) Inventors: Roland Zengerle, Waldkirch (DE); Peter Koltay, March (DE); Wolfgang Streule, Waldkirch (DE); Gerhard Birkle, Freiburg (DE)

( * ) Notice: Subject to any disclaimer, the term of this patent is extended or adjusted under 35 U.S.C. 154(b) by 1003 days.

(21) Appl. No.: 11/353,681

(22) Filed: Feb. 14, 2006

(65) Prior Publication Data

US 2006/0147313 A1 Jul. 6, 2006

Related U.S. Application Data

(63) Continuation of application No. PCT/EP2004/009063, filed on Aug. 12, 2004.

(30) Foreign Application Priority Data

Aug. 14, 2003 (DE) ..... 103 37 484

(51) Int. Cl.

| | |
|---|---|
| ***B05B 1/30*** | (2006.01) |
| ***B05B 15/00*** | (2006.01) |
| ***B05B 1/00*** | (2006.01) |
| ***F04B 43/12*** | (2006.01) |
| ***F04B 43/08*** | (2006.01) |

(52) U.S. Cl. ..... 239/11; 239/533.13; 239/546; 239/576; 239/602; 239/DIG. 12; 417/53; 417/474; 417/478

(58) Field of Classification Search ..... 239/11, 239/102.1, 102.2, 119, 533.13, 546, 576, 239/602, DIG. 12; 417/44.1, 53, 412, 413.2, 417/413.3, 474, 476, 478; 222/214; 347/44, 47, 54, 74

See application file for complete search history.

(56) References Cited

U.S. PATENT DOCUMENTS

| | | | | |
|---|---|---|---|---|
| 3,171,360 | A * | 3/1965 | Walton | 417/474 |
| 3,683,212 | A | 8/1972 | Zoltan | |
| 4,015,914 | A | 4/1977 | Kushner et al. | |
| 4,252,447 | A | 2/1981 | Borodin | |
| 5,593,290 | A | 1/1997 | Greisch et al. | |
| 6,280,148 | B1 | 8/2001 | Zengerle et al. | |

(Continued)

FOREIGN PATENT DOCUMENTS

| | | |
|---|---|---|
| DE | 2 240 685 | 11/1973 |

(Continued)

OTHER PUBLICATIONS

English translation of Japanese Office Action dated May 12, 2009.

(Continued)

*Primary Examiner* — Darren W Gorman
(74) *Attorney, Agent, or Firm* — Laurence A. Greenberg; Werner H. Sterner; Ralph E. Locher

(57) ABSTRACT

A microdosing apparatus and method include a fluid conduit having a flexible tube with a first end for connecting to a fluid reservoir and a second end where an outlet opening is located. An actuating device with a displacer with an adjustable stroke is provided, by which the volume of a portion of the flexible tube can be changed to thereby dispense liquid as free flying droplets or as a free flying jet at the outlet opening by moving the displacer between a first end position and a second end position, whereby the tube is partly compressed in the first or the second end position.

22 Claims, 9 Drawing Sheets

U.S. PATENT DOCUMENTS 6,416,294 B1 7/2002 Zengerle et al.

FOREIGN PATENT DOCUMENTS

| | | | |
|---|---|---|---|
| DE | 29 21 767 | A1 | 1/1980 |
| DE | 43 14 343 | A1 | 11/1994 |
| DE | 198 02 368 | C1 | 8/1999 |
| DE | 198 02 367 | C1 | 9/1999 |
| EP | 0119573 | A1 | 9/1984 |
| EP | 0 725 267 | A2 | 8/1996 |
| GB | 1 470 515 | | 4/1977 |
| JP | 59188539 | A | 10/1984 |
| JP | 60189834 | U | 12/1985 |

OTHER PUBLICATIONS

Stemme et al.: "A valveless diffuser/nozzle-based fluid pump", Elsevier Sequoia, Sensors and Actuators, A, 39, 1993, pp. 159-167.

* cited by examiner 150
152
154
156
160
162
164
166
168
170
172
A
B

MICRODOSING APPARATUS AND METHOD FOR DOSED DISPENSING OF LIQUIDS

CROSS-REFERENCE TO RELATED APPLICATIONS

This is a continuation, under 35 U.S.C. §120, of copending international application PCT/EP2004/009063, filed Aug. 12, 2004, which designated the United States; this application also claims the priority, under 35 U.S.C. §119, of German patent application DE 103 37 484.1, filed Aug. 14, 2003; the prior applications are herewith incorporated by reference in their entirety.

BACKGROUND OF THE INVENTION

1. Field of the Invention

The present invention relates to a microdosing apparatus, to methods for dosed dispensing of liquids and to methods for adjusting a desired dosing volume range when using an inventive microdosing apparatus.

2. Description of the Related Art

According to the prior art, volumes in the nanoliter range ($10^{-12}$ $m^3$) are not dosed with conventional pipettes, but require specific methods to ensure the required precision.

Here, in addition to contact methods, conventional dispensing methods, pin printing methods, etc., contactless methods are of significant importance.

A class of known methods is based on fast-switching valves. Therefore, a suitable valve, mostly based on magnetic or piezoelectrical drives, is connected to a media reservoir via a conduit and pressure is built up in the same. By the fast switching of the valve with a switching time of less than 1 ms, a very large flow is generated for a short term, so that the fluid, even with high surface tensions, can separate from the dispensing position and can impinge on the substrate as free jet. The dosing amount can be controlled by the pressure and/or the switching time of the valve.

Different approaches exist for generating the pressure, there are in the above-described concept with switched valves.

A schematic representation showing a first known approach, which can be referred to as syringe solenoid method, is shown in FIG. 7. Here, a fluid conduit 10 is fluidically connected to a syringe 14, which can be removable, via a fast-switching microsolenoid valve 12. At the lower end of the syringe 14, there is a nozzle opening 16. The opposite end of the fluid conduit 10 is connected to a syringe pump 20 via a switching valve 18. Further, a fluid reservoir 22 is also connected to the switching valve 18 via a further fluid conduit 24.

The switching valve 18 has two switching states. In a first switching state, a pump chamber 26 of the syringe pump 20 is fluidically connected to the fluid reservoir 22 via the fluid conduit 24, so that liquid 28 can be drawn from the fluid reservoir into the pump chamber 26, by increasing the volume of the pump chamber 26 by a corresponding movement of the piston 30 of the syringe pump. This process serves to fill the syringe pump 20. In a subsequent dosing process, the switching valve 18 is switched to effect a fluidic connection of the pump chamber 26 to the microsolenoid valve 12 via the fluid conduit 10. By using the piston 30, pressure is applied to the liquid inside the pump chamber 26, so that by fast switching the microsolenoid valve 12 (switching time <1 ms), liquid can be dispensed from the dosing opening 18 of the syringe 14. Dosing apparatuses of the type shown in FIG. 7 are, for example, sold by the company Cartesian.

An alternative principle, as is practiced, for example, by the companies Delo and Vermes, is shown in FIG. 8. In this alternative method, a pressure container 40 is provided, containing liquid 42 under pressure. An outlet of the pressure container 40 is connected to a quickly switchable valve 46 via a fluid conduit 44, which is again connected to a nozzle opening, shown merely schematically as arrow in FIG. 8, via a fluid conduit 48. In this arrangement, liquid can also be dispensed in a free jet from the nozzle opening by fast switching of the valve 46.

Alternative known microdosing apparatuses are, for example, described in DE-A-19802367, DE-A-19802368 and EP-A-0725267. The microdosing apparatuses described there comprise a pump chamber abutting to a flexible membrane and connected to a reservoir via a supply line and to a nozzle opening via a drain. An example for such a microdosing apparatus will be discussed below with reference to FIGS. 9*a*-9*c*.

In FIG. 9*a*, a schematic cross section through such a microdosing apparatus in the resting position is shown. The dosing apparatus comprises a dosing head 50 and an actuating device 52. In the shown example, the dosing head 50 is formed by two interconnected substrates 54, 56, in which respective recesses are formed. The first substrate 54 is structured such that a reservoir connection 58, an inlet channel 60 and a dosing chamber 62 are formed in the same. The lower substrate 56 is structured such that a nozzle connection 64, a nozzle 66 having a nozzle channel and an outlet opening, and an outlet area 68 having a significantly larger cross section than the outlet opening of the nozzle 66 are formed in the same.

Further, a membrane 70 is formed the upper substrate 54 by the structuring of the same.

The actuating device 52 has a displacer 72, by which the membrane 70 can be deflected downwards to reduce the volume of the dosing chamber 62, as shown in FIG. 9*b*. By this reduction of the volume of the dosing chamber 72, on the one hand, a backflow 74 results through the inlet channel 60 and the reservoir connection 58. On the other hand, a forward flow results through the nozzle connection 64 and the nozzle 66, so that dispensing liquid 76 takes place at the outlet end of the nozzle 66. The ratio between backflow 74 and dosed liquid 76 depends on the ratio of flow resistance of fluid connection between reservoir and dosing chamber to the flow resistance between dosing chamber and outlet opening of the nozzle 66.

After the dosing process, the displacer 72 is moved upwards by using the actuating device 52, see FIG. 9*c*, so that the same finally resumes its original position by elasticity, as shown in FIG. 9*a*. By this resetting of the membrane 70, an increase of the volume of the dosing chamber 62 results, so that a refill flow 78 from the reservoir through the reservoir connection 58 and the inlet channel 60 occurs. In order to avoid an intake of air through the nozzle 66 during this phase, resetting the membrane 70 has to be performed slowly enough, so that capillary forces keeping the liquid in nozzle 66 are not overcome thereby.

Microdosing apparatuses as described above with reference to FIGS. 9*a*-9*c* have originally been developed for enzyme dosage in biochemistry. By using these apparatuses, liquids with viscosities up to 100 mPas in a volume range of 1 nL to 1000 nL can be dosed very media independent and precisely. The liquid to be dosed is thereby dosed by displacing a dosing chip, preferably made of silicon, in free jet from the dosing chamber, which is. However, this method requires a comparatively complex micro device.

Finally, a droplet ejection system is known from U.S. Pat. No. 3,683,212, wherein a tube shaped piezoconverter connects a fluid conduit to a nozzle plate wherein a nozzle opening is formed. A voltage pulse with short rise time is applied to the converter to effect contraction of the converter. The resulting sudden decrease of the enclosed volume causes a small amount of fluid to be ejected from the opening in the opening plate. Thereby, the liquid is kept under no or no low pressure. The surface tension at the opening prevents that liquid flows out when the converter is not operated.

The ejected liquid is replaced by a capillary forward flow of liquid in the conduit.

It has been found out that according to U.S. Pat. No. 3,683,212, the drop is generated with the help of an acoustic principle similar to the piezoelectric inkjet methods. Here, an acoustic pressure wave is generated in a rigid fluid conduit, for example a rigid glass capillary, which results in a high pressure gradient locally at an output position, which leads to drop separation. The actuating time of the actuator is here in the range of the sound propagation in the system, which is normally several microseconds. Thus, in this context, the acoustic impedance of the fluid conduits below and above the actuator is of significance for the design. Thus, this is an impulse method where a high acoustic impulse is generated with a low volume displacement. In other words, a sound wave with pressure maxima and pressure minima is generated between the actuation position and the disposing position, wherein ejection of liquid is effected at the dispensing position by a corresponding pressure. According to U.S. Pat. No. 3,683,212, the fluid conduit is only negligibly deformed, the actuator mainly only transmits sound and the elasticity of the fluid conduit has no significant importance.

From DE 4314343 C2, an apparatus for dosing liquids is known, having a liquid supply tube connected at one end to a liquid reservoir and open at the other end. The tube is applied to an abutment socket and a hammer is provided on the side opposing the abutment socket of the tube. The hammer can vibrated periodically in a direction transversal to the tube axis, so that the whole tube cross section is crimped by the hammer, i.e. the flow area is substantially brought to zero. Thereby, impulsive force impacts are exerted on the tube and individual liquid drops are driven out of the open end.

SUMMARY OF THE INVENTION

It is an object of the present invention to provide a microdosing apparatus with a simple structure, which further preferably allows an easy change of a dosing volume to be dispensed. It is a further object of the present invention to provide a method for dosed dispensing of liquids.

In accordance with a first aspect, the present invention provides a microdosing apparatus having: a fluid conduit having a flexible tube, preferably a polymer tube, with a first end for connecting to a liquid reservoir and a second end where an output opening is located; and an actuating device having a displacer with adjustable stroke, by which the volume of a portion of the flexible tube can be changed, to thereby dispense liquid as free flying droplets or as free flying jet at the outlet opening by moving the displacer between the first end position and the second end position, wherein the tube is partly compressed at least in the first end position or the second end position.

In accordance with a second aspect, the present invention provides a microdosing apparatus, having: a fluid conduit with a first end for connecting to a fluid reservoir and a second end where an outlet opening is located, the fluid conduit having a portion along which a cross section of the fluid conduit can be varied to effect a change of the volume of the fluid conduit; an actuating device disposed at a position along the portion of the fluid conduit for effecting a change of the volume of the fluid conduit to thereby dispense liquid as free flying droplets or free flying jet from the outlet opening; wherein a ratio of the fluidic impedance between the position of the actuating device and the outlet opening to a fluidic impedance between the fluid reservoir and the position of the actuating device is variable by changing the position of the actuating device, so that a dosing volume dispensed at the outlet opening is variable by at least 10%.

Here, fluidic impedance means the combination of fluidic resistance and fluidic inductance determined by the length and the flow cross section of a line.

Thus, the present application allows adjusting of the dosing volume either by adjusting the stroke of the actuating device and/or adjusting the position of the actuating device along a fluid conduit whose volume can be changed.

Such a variability of the ratio of the mentioned flow resistances can be preferably achieved by designing the fluid conduit between fluid reservoir and ejection opening with a substantially linear structure, i.e. the same has a cross section without erratic cross section changes between fluid reservoir and ejection opening. In the simplest case, this can be achieved by a fluid conduit having a substantially constant cross section between fluid reservoir and ejection opening in the resting position.

The present invention requires no fine-mechanical or microstructured members as required in other drop generators, whereby production costs can be significantly reduced and the operation security is increased. Further, the fluid carrying part can be produced as disposable members, simply of plastics, for example polyimide, whereby an expensive cleaning when changing media is omitted.

Further, according to the invention, no limited pressure chamber is used for generating pressure, but a variable "active area". Thereby, optimization possibilities result for different fluids by varying the displacer position, i.e. the position of the actuating device along the portion of the fluid conduit along which the cross section of the fluid conduit can be varied to effect a change of the volume of the fluid conduit. By an axially asymmetric volume change, a preferred direction of a fluid flow can be generated in the fluid conduit in the direction of the outlet opening. Further, a simple change of the maximum dosing volume can be caused by increasing the "active area", for example by using a larger displacer, wherein such change of the maximum dosing volume does not require construction changes at the fluid carrying parts. Finally, a potential pressure difference between input opening and output opening can be explicitly provided to ensure a preferred direction during refill or to avoid leaking of the liquid from the outlet opening. Thus, media that cannot be moved by capillary forces in the fluid conduit can also be dosed.

In accordance with a third aspect, the present invention provides a method for dosed dispensing of liquids, having the steps of: filling a fluid conduit having a flexible tube, preferably a polymer tube, with a liquid to be dosed; effecting a volume change of a portion of the flexible tube by a displacer with adjustable stroke, to thereby dispense liquid as free flying droplets or as free flying jet at an outlet opening of the fluid conduit by moving the displacer between a first end position and a second end position, wherein the tube is partly compressed at least in the first end position or the second end position.

In accordance with a fourth aspect, the present invention provides a method for adjusting a desired dosing volume in a dosing process by using an inventive microdosing apparatus, having the step of: disposing the actuating device at a predetermined position along the portion of the fluid conduit, so that due to the resulting ratio of fluidic impedances in the step of effecting a change of the volume of the fluid conduit, a desired dosing volume can be dispensed at the outlet opening.

In accordance with a fifth aspect, the present invention provides a method for adjusting a desired dosing volume in a dosing process by using an inventive microdosing apparatus, having the step of: selecting a displacer with an axial length with regard to the portion of the fluid conduit, which is adapted to allow dispensing of a desired dosing volume in a step of effecting a change of the volume of the fluid conduit.

Thus, the present invention allows additional degrees of freedom when adjusting a desired dosing volume. On the one hand, with a predetermined stroke and thus a predetermined displacement of the actuating device, a desired dosing volume can be adjusted by the above-described steps. If the stroke and thus the displacement of the actuating device are adjustable, a desired dosing volume range can be adjusted by the above-mentioned steps, wherein then the dosing volume lying within the desired dosing volume range can be adjusted by adjusting the stroke or the displacement of the actuating device, respectively.

A characteristic property and a significant advantage of volume displacer systems, as they are realized by the present invention, is that in the same the dosing volume is largely independent of the viscosity of the liquid to be dosed.

Above that, according to the present invention, the actuating device can be designed together with the fluid conduit to allow a full crimping of the fluid conduit by the displacer as an extreme case of volume displacement. In that case, additionally, a valve function can be implemented. The possibility of fully interrupting the fluid conduit between reservoir and dispensing position can thus represent a further advantage compared to known methods.

In contrast to the teachings of U.S. Pat. No. 3,683,212, in the inventive microdosing apparatuses, a continuous pressure gradient is built up across the whole fluid conduit, wherein the fluid is actually pushed out of the conduit starting from the displacer. The whole fluid between displacer and outlet opening is moved in direction of the outlet opening. Acoustic phenomena play no part, since the volume displacement is performed on a time scale of a few milliseconds (significantly slower than with impulse methods).

BRIEF DESCRIPTION OF THE DRAWINGS

These and other objects and features of the present invention will become clear from the following description taken in conjunction with the accompanying drawings, in which.

DESCRIPTION OF THE PREFERRED EMBODIMENTS

With regard to the schematic representations in FIGS. 1*a* to 1*c*, the essential features of the present invention as well as the concept underlying the same will be discussed below.

The present invention relates to an apparatus or a method, respectively, for generating microdrops or microjets, respectively, mainly in the nanoliter to picoliter range. A fluid carrying conduit is a central element of an inventive microdosing apparatus, whose inlet opening is connected to a liquid reservoir, in which the media to be dosed is located. On the other end of the conduit is an outlet opening through which the liquid to be dosed can be dispensed. The fluid carrying conduit is preferably mainly made of an elastic material, so that the volume of the conduit between inlet opening and outlet opening can be varied by deforming the conduit, for example compressing the same.

Figure 1A:
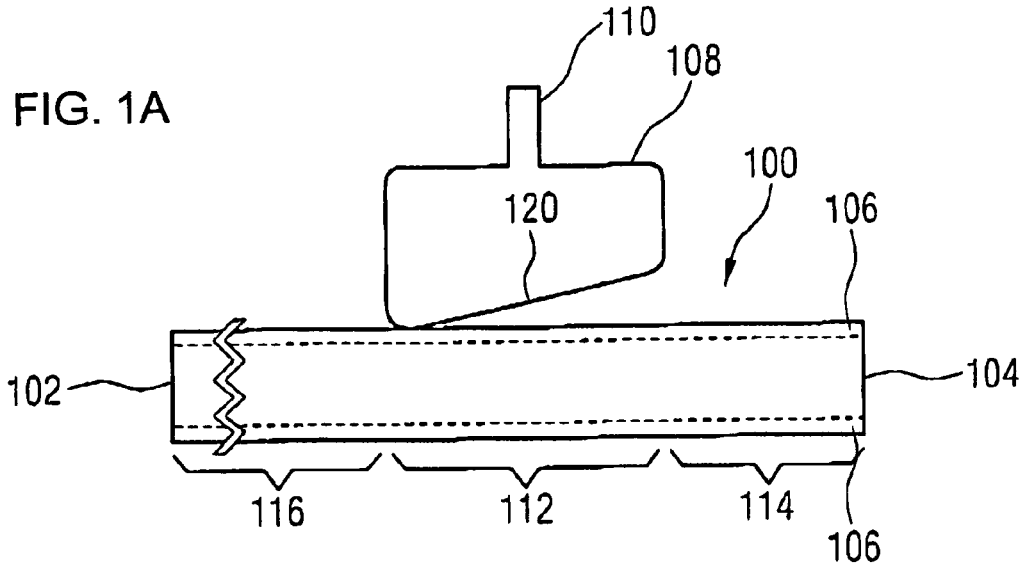
FIGS. 1*a*-1*c* are schematic cross section views for explaining an embodiment of an inventive dosing process.
Figure 1B:
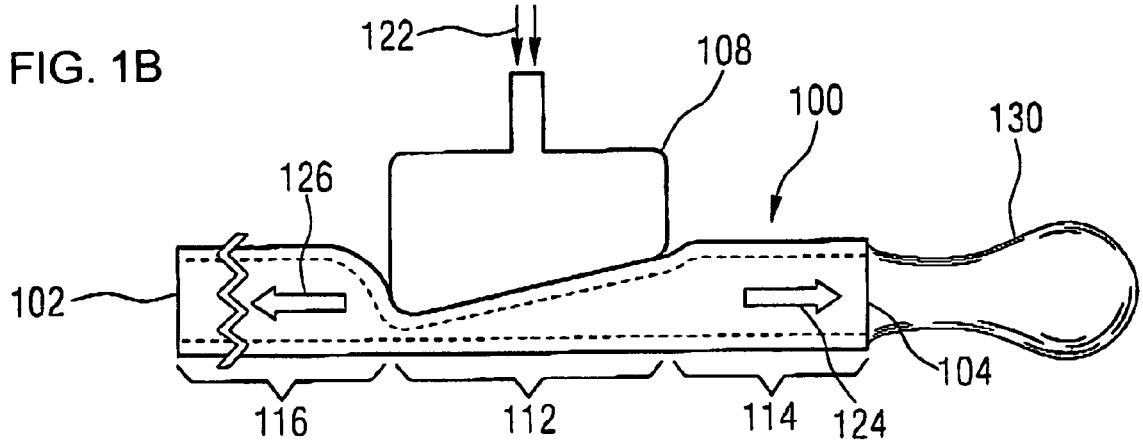
Figure 1C:
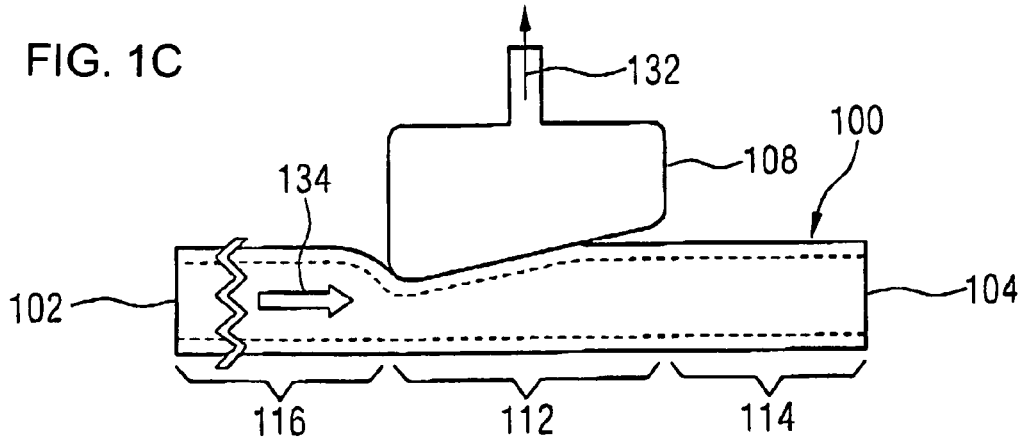

The essential elements of an inventive dosing apparatus during different phases of a dosing process are shown in FIGS. 1*a* to 1*c*.

As shown in FIG. 1*a*, a fluid conduit 100, which is an elastic polymer tube in preferred embodiments of the present invention, comprises an inlet-side end 102, which serves for connecting to a fluid reservoir, and an outlet-side end 104 where microdrops or microjets, respectively, can be dispensed. The outlet-side end 104 can thus also be referred to as nozzle. Respective walls 106 of the elastic polymer tube 100 are illustrated in FIGS. 1*a* to 1*c* by dotted lines.

An actuator 108 in form of a displacer is provided, which has a connection part 110 where the displacer 108 can be attached to an actuating member for driving the displacer 108.

In the shown embodiment, the elastic polymer tube has a substantially constant cross section, which will normally be circular, from its input end 102 to its output end 104.

In such a microdosing apparatus, an area 112 disposed below the displacer 108 can be referred to as dosing chamber area, which is defined by the position of the displacer 108 with regard to the elastic polymer tube 100. An area 114 beginning substantially at the right end of the displacer 108 represents an outlet channel fluidically connecting the displacer area 112 to the outlet end 104. An area 116, which is illustrated in the figures in a reduced form and extends from the left end of the displacer 108 towards the left, represents an input channel fluidically connecting the displacer area 112 to the input end 102.

As further shown in FIG. 1*a*, the displacer 108 can comprise a displacer surface 120 running diagonally to the wall 106 of the polymer tube 100, which allows generation of a preferred direction of a fluid flow in direction towards the outlet opening 104 by an axially asymmetric volume change during operation of the microdosing apparatus.

In the following, the mode of operation of the inventive microdosing apparatus will be discussed.

When switching on the dosing system, the fluid conduit 100 will be filled automatically either by an externally generated pressure difference or by capillary forces.

An externally generated pressure difference can, for example, be applied by using a fluid reservoir wherein the fluid is put under pressure.

When applying a static pressure positive with regard to the outlet end (overpressure), it has to be considered that the pressure by which the liquid in the conduit 100 is provided, is not higher than the capillary forces by which the liquid is kept in the conduit, since otherwise leaking of liquid would occur from the output end 104 in the non-operated state of the microdosing apparatus.

Alternatively, pressure negative with regard to the output end (underpressure) can be applied to avoid leaking of liquid from the output end in the non-operated state if the capillary forces are too weak. This opposing pressure has to be overcome by the capillary forces during refill.

At the beginning of a dosing process, in a first phase, which can be referred to as dosing phase, liquid is displaced from the conduit by reducing the conduit volume between inlet opening and outlet opening. This is achieved by moving the displacer 108 downwards, i.e. in direction towards the polymer tube 100, so that a compression of the polymer tube occurs in the displacer area 112. This downward movement is illustrated in FIG. 1*b* by arrows 122. Thus, the displacer area 112 represents the active area of the inventive microdosing apparatus.

The liquid displaced from the conduit due to this volume change of the fluid conduit 100 is pressed out of the ends of the conduit or stored at another position by changing the conduit cross section when the conduit has a fluidic capacity.

By the volume change of the fluid conduction 100 caused by a fast movement 122 of the displacer 108, on the one hand, a fluid flow towards the outlet opening 104 takes place, as indicated by an arrow 124. On the other hand, a backflow into the fluid reservoir through the input channel 116 takes place, as indicated by an arrow 126. By the forward flow 124, a fluid ejection in the form of a microdrop or a microjet, respectively, takes place at the outlet opening 104.

Which portion of the fluid will be dispensed through the outlet opening 104 as jet or drop, respectively, depends on the position, type and dynamic of the volume change. As has already been mentioned above, a preferred direction of the current in the direction towards the outlet opening 104 can be affected by an axially asymmetrical volume change as caused by the displacer 108 and particularly the displacer surface 120. For generating a jet or a drop dispensed in the dosing phase at the outlet end 104, the volume change occurs sufficiently fast to transfer the required impulse to the fluid drop or fluid jet, respectively, so that the same can separate from the outlet opening 104. Thereby, both the fluid properties, such as density, viscosity, surface tension and the same, as well as a pressure difference that can exist between inlet opening and outlet opening play an important part. Further, the fluidic resistances between outlet opening 104 and the active area 112, wherein the volume change is performed (i.e. the fluidic impedance of the outlet channel 114) as well as the fluidic impedance of the conduit part between active area 14 and inlet opening 112 (i.e. the fluidic impedance of the inlet channel 116) are determining for the ratio between dispensed dosing amount (forward flow 124) and the fluid amount fed back into the reservoir (backflow 126). A good dosing quality can, for example, be achieved when the volume change is performed close to the outlet opening (104) with high dynamic (for example 50 nL within one millisecond).

By positioning the displacer close to the outlet opening (104), it can be effected that the fluidic impedance of the outlet channel 114 is low compared to the fluidic impedance of the inlet channel 116, so that a large part of the displaced fluid is ejected from the outlet opening 104. Thereby, it can be said that the displacer is disposed close to the outlet opening 104 when the length of the inlet channel 116 is at least twice the size of the length of the outlet channel 114, preferably at least five times as large and more preferred at least ten times as large.

After ejecting the fluid drop or fluid jet, respectively, in a second phase, which can be referred to as refill phase, the volume between inlet opening 102 and outlet opening 104 is increased again. This is achieved by moving the displacer 108 away from the fluid conduit 100 in the direction of an arrow 132, as shown in FIG. 1*c*. Due to this volume change, liquid flows from the reservoir through the inlet opening 102 and the inlet channel 116 into the conduit and particularly into the active area 112 of the same, as indicated in FIG. 1*c* by arrow 134. The drawing in of air through the outlet opening 104 is prevented through capillary forces, with correspondingly small conduit cross sections. Alternatively, a preferred direction for filling from the reservoir can be determined by a hydrostatic pressure difference between inlet opening and outlet opening. For this purpose, the fluid reservoir could, for example, again be provided with pressure.

At the end of the refill phase, again, the situation shown in FIG. 1*a* is present, wherein then a dosing process can be preformed again.

Figures 2A, 2B, 2C, 2D:
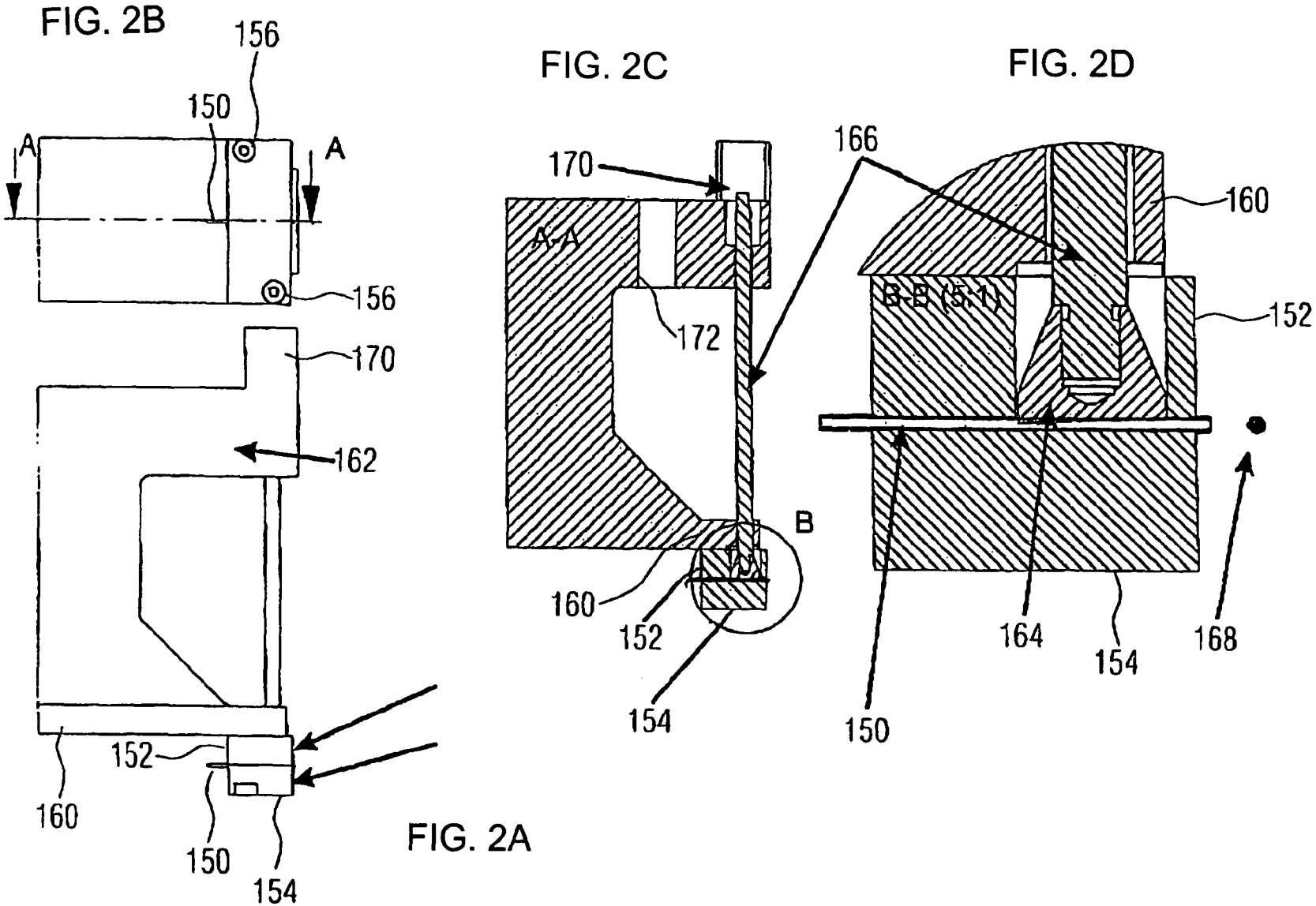
FIGS. 2*a*-2*d* are schematic views of an embodiment of an inventive microdosing apparatus.

FIGS. 2*a* to 2*d* show a drop generator using an inventive microdosing apparatus with respective mounts for the fluid conduit or the actuator, respectively. FIG. 2*a* shows a side view of the drop generator, while 2*b* shows a bottom view of the same. FIG. 2*c* shows a sectional view along line A-A of FIG. 2*b*, while FIG. 2*d* illustrates an enlargement of portion B in the scale 5:1.

The drop generator shown in FIGS. 2*a* to 2*d* comprises a polyimide tube 150, which can have, for example, an inner diameter of 200 μm. For storing the polyimide tube 150, a storage block 152 and an abutment block 154 are provided. A guide groove is provided in the storage block 152 and/or the abutment block 154, wherein the polyimide tube is inserted, so that the polyimide tube is securely stored between storage block and abutment block in a stabilized way. The storage block 152 and the abutment block 154 are, for example, attached to a mounting portion 160 of a mount 162 by using mounting screws 156. Further, the mount 162 is formed to hold a displacer 164 on the side of the polyimide tube 150 opposing the abutment 154, with the help of which the tube can be compressed in the active area of the same, whereby the inventive volume change between inlet opening and outlet opening is obtained. Thereby, the displacer is driven by a piezostack actuator (not shown), whose displacement can be electronically controlled, and which is connected to the displacer 164 via an adapter 166. In order to effect a preferred direction of a drop ejection 168 by the outlet opening of the polyimide tube 150, the displacer 164 again has a displacing surface, which is diagonal in relation to the polyimide tube, i.e. running in an angle to the same.

Further, the mount 162 comprises a receiver 170 for the driving unit in the form of the piezostack actuator. Further, the mount 162 can have a recess 172 penetrating the same to allow attaching the same at a device, which also includes the drive unit, for example by using a screw joint.

Figure 3:
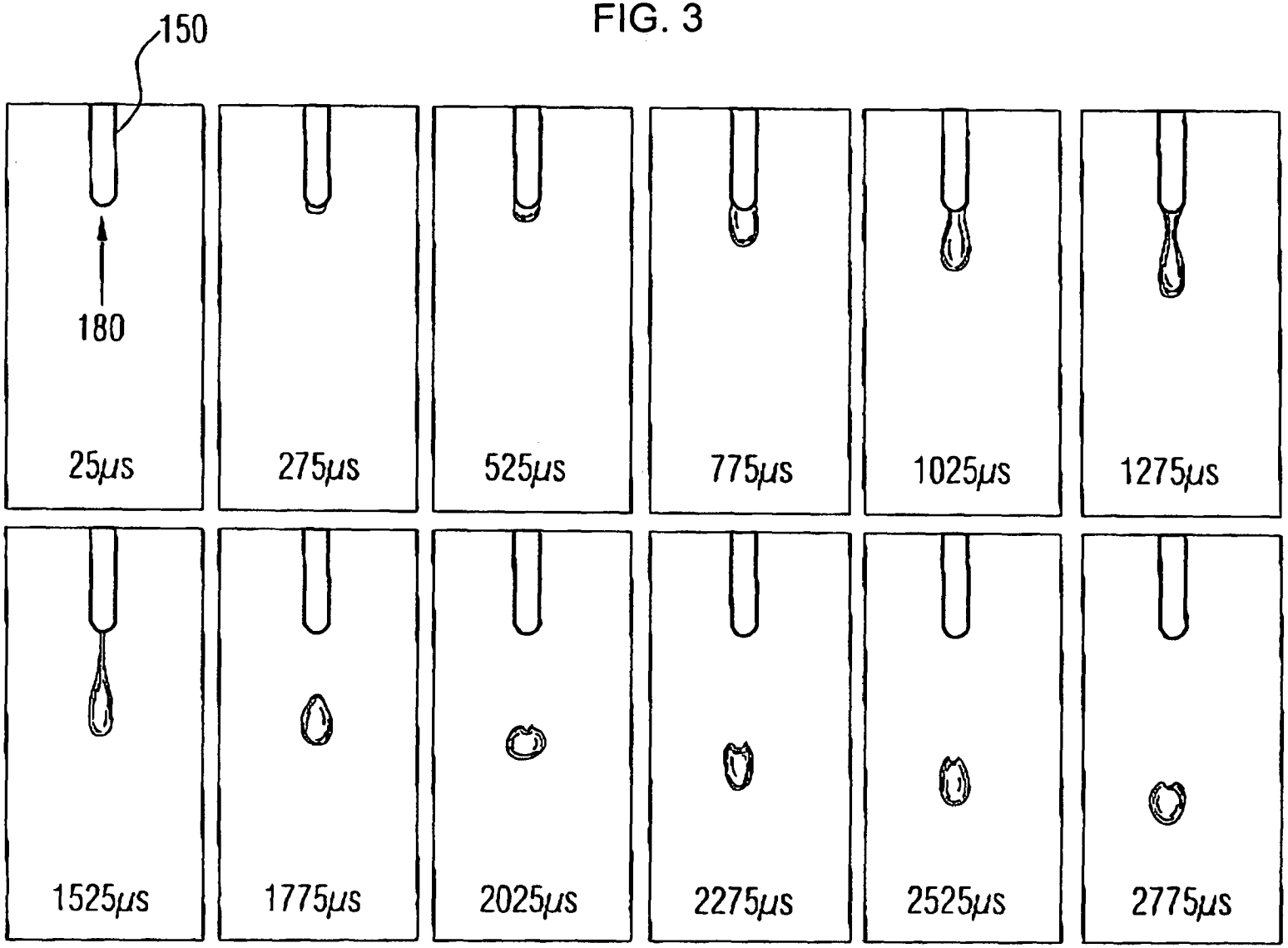
FIG. 3 is a schematic image sequence of the drop formation.

With regard to the structure shown in FIGS. 2*a* to 2*d*, a prototype has been built and successfully experimentally tested. FIG. 3 shows different phases of a dosing process performed with the prototype, wherein the polyimide tube 150 is shown with its outlet end 180 in each case.

Figure 4:
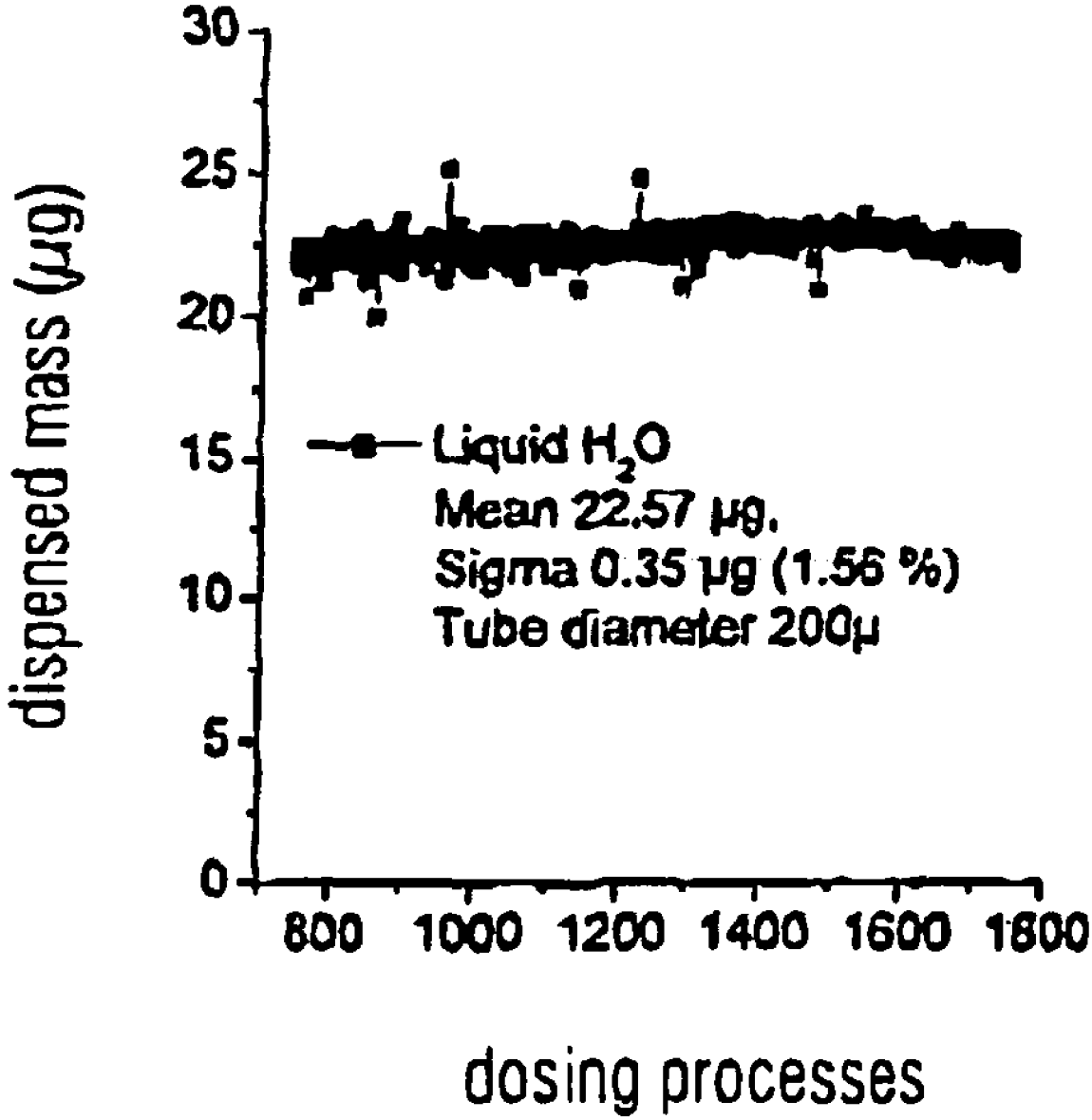
FIG. 4 is a diagram showing drop volumes generated via a prototype.

FIG. 4 shows the dispensed mass in microgram with a number of 1800 dosing processes by using the prototype, wherein water has been used as liquid to be dosed. The medium drop mass was 22.57 μg, with a standard deviation σ of 0.35 μg. The polyimide tube had a diameter of 200 μm. The gravimetric measurement of the reproducibility illustrated in FIG. 4 proves that a precision at least corresponding to the one of conventional dosing apparatuses and even superior to the same can be obtained with the inventive concept.

With regard to FIGS. 5*a*, 5*b*, 6*a* and 6*b*, it will be discussed below how a desired dosing volume or a desired dosing volume range, respectively, can be adjusted in an inventive microdosing apparatus.

Figure 5A:
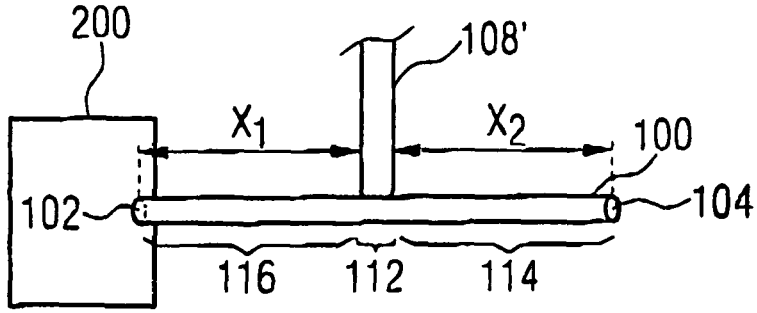
FIGS. 5*a*-5*b* are schematic representations for illustrating how a dosing volume range can be adjusted in an inventive microdosing apparatus.
Figure 5B:
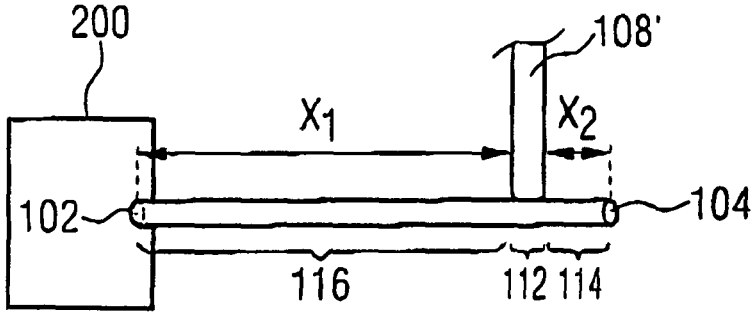

In FIGS. 5*a* and 5*b*, the polymer tube 100 is shown schematically, whose inlet opening 102 is fluidically connected to a liquid reservoir 200 and whose outlet end 104 represents an ejection opening. The active area 112 as well as the outlet channel 114 and the inlet channel 116 are defined by the position of the displacer 108. In the arrangement shown in FIG. 5*a*, the input channel 116 and the outlet channel 114 have substantially the same lengths $x_1$ and $x_2$, so that the fluidic impedance of the same is substantially identical, when a constant cross section of the tube 100 is assumed. Thus, in the shown form of the displacer 108', which effects no preferred flow direction, a volume displacement effected by the displacer 108' would cause that flows of the same size would flow in the direction of the outlet opening 104 and the inlet opening 102. Thus, when neglecting the fluid capacity of the tube conduit 100, the volume ejected by the outlet opening 104 would be half as much as the volume displacement caused by the displacer 108'.

According to FIG. 5*b*, the displacer 108' is disposed close to the outlet opening 104. In other words, the length $x_1$ of the inlet channel 116 is about five times as large as the length of the outlet channel $x_2$. Thus, with a constant cross section of the tube 100, the fluidic impedance of the inlet channel 116 is five times as high as the one of the outlet channel 114, so that a much higher portion of the volume change effected by the displacer 108' effects a flow in the direction of the outlet opening 104 and thus an ejection through the same.

In the above-mentioned way, a desired dosing volume can be adjusted by changing the position of the displacer relative to the fluid conduit 100. Further, if the drive means of the displacer allows a selective adjusting of the stroke of the same, i.e. a selective adjustment of the movement of the same by different distances vertically to the fluid conduit, so that the displacer can effect different volume changes in the dependence on its control, the above adjustment of the position can represent an adjustment of a desired dosing volume range, while the final adjusting of the desired dosing volume in the adjusted dosing volume range is performed by a corresponding control of the displacer.

According to the invention, the dosing volume dispensed at the outlet opening is adjustable by changing the position of the displacer, as long as the ratio of the flow resistances from inlet channel and outlet channel can be significantly changed by changing the position of the displacer. Here, significantly should mean a change which causes a change of a dosing volume dispensed at the outlet opening by at least 10%, whereby the actual adjustment range will depend on across which range the position of the displacer can be adjusted. Thereby, by using the inventive microdosing apparatuses, changes of the dispensed dosing volume by 50% and above can be realized by changing the position of the displacer. This inventive adjustability of the ratio of the flow resistances of inlet channel and outlet channel is preferably enabled according to the invention in that no erratic cross section changes occur between dosing chamber, i.e. active area, and inlet channel or outlet channel, respectively. In even more preferred embodiments of the present invention, the cross section of the fluid conduit is constant from the segment of displacement, i.e. the active area, to the outlet opening in the resting position. Further, in preferred embodiments, the whole fluid conduit between fluid reservoir and outlet opening has a substantially constant cross section.

Figure 6A:
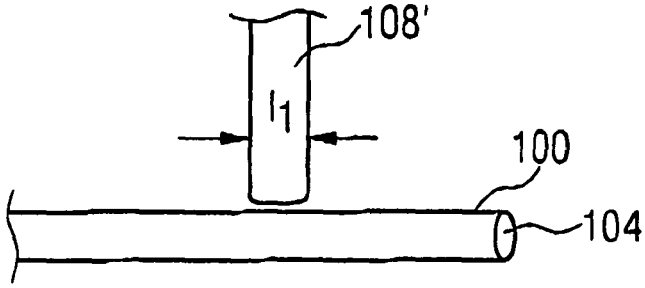
FIGS. 6*a*-6*b* are schematic views for illustrating how a dosing volume range can alternatively be adjusted according to the invention.
Figure 6B:
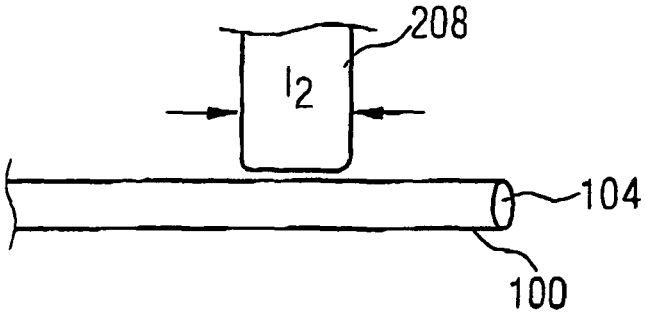
Figure 7:
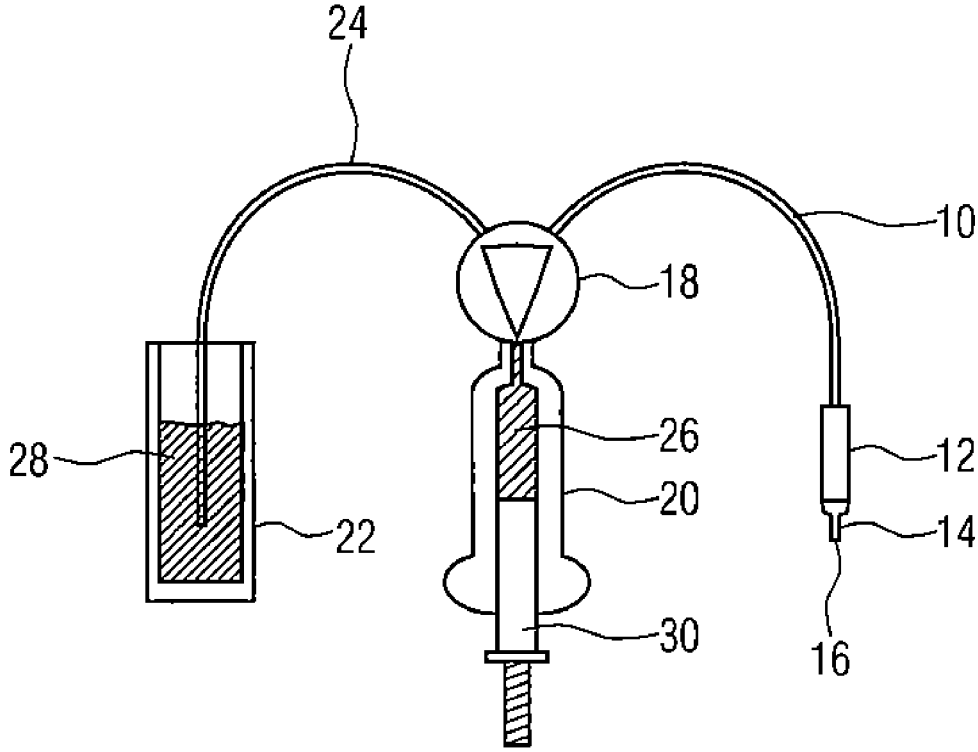
FIG. 7 PRIOR ART
FIGS. 7, 8, 9*a*-9*c* are schematic representations of known microdosing systems.
Figure 8:
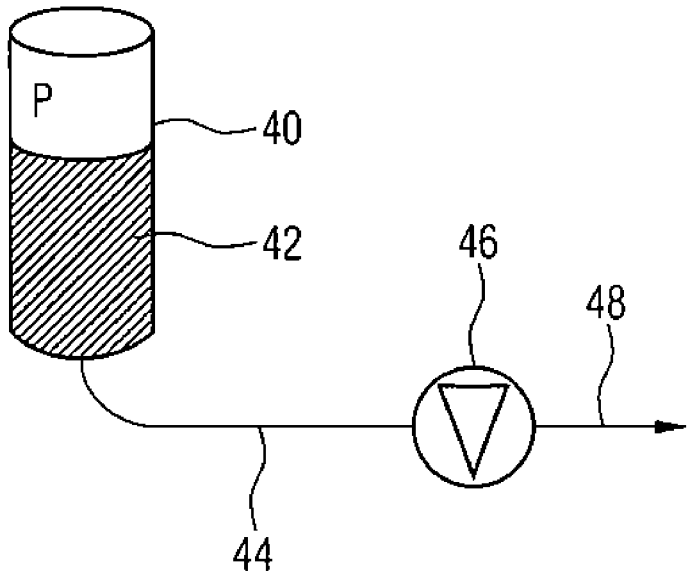
FIG. 8 PRIOR ART
Figure 9A:
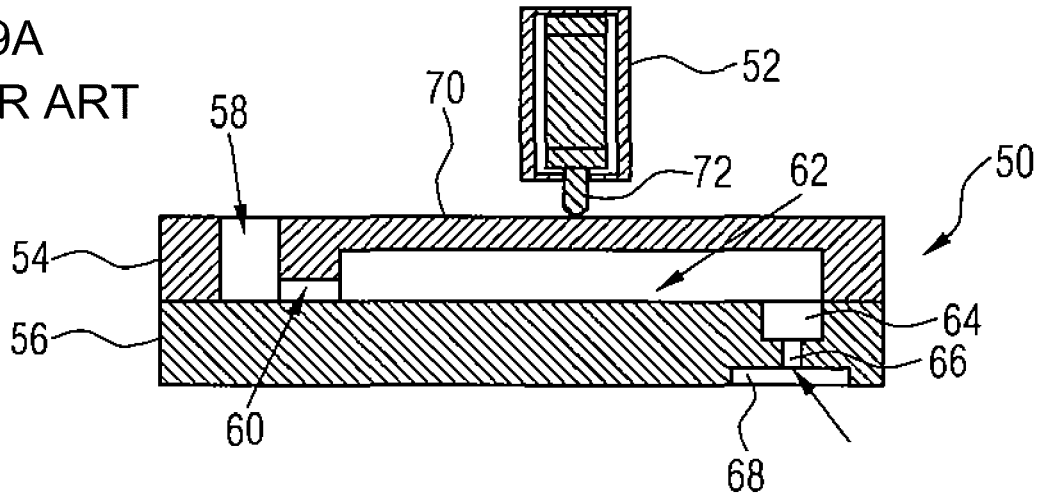
FIG. 9A PRIOR ART
Figure 9B:
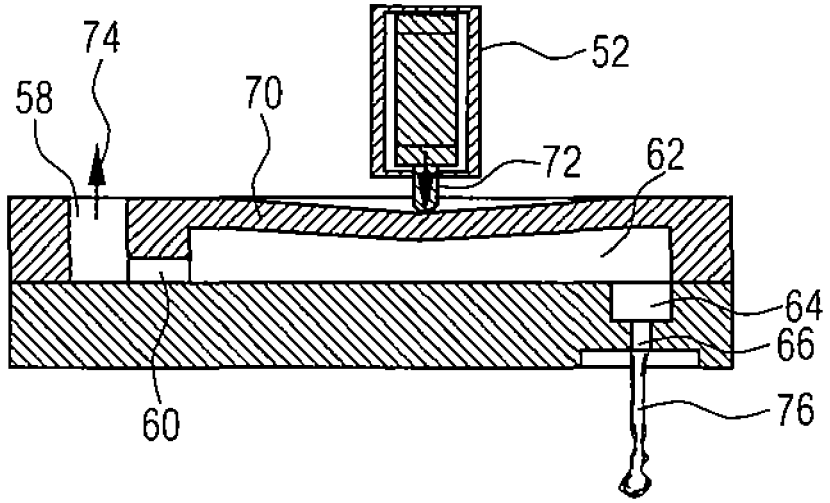
FIG. 9B PRIOR ART
Figure 9C:
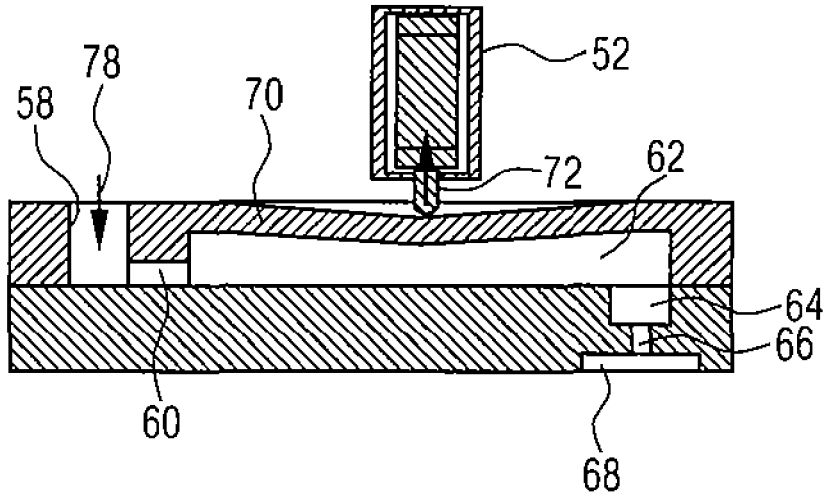
FIG. 9C PRIOR ART

A second possibility, how a desired dosing volume or a desired dosing volume range, respectively, can be adjusted according to the invention, can be taken from FIGS. 6*a* and 6*b*. According to FIG. 6*a*, the displacer 108' has a length $l_1$ along the tube 100, while according to FIG. 6*b*, a displacer 208 has a length $l_2$ along the tube 100. The length $l_2$ is longer than the length $l_1$, so that the displacer 208 allows a larger volume change of the fluid conduit 100 with the same stroke. Thus, according to the invention, by changing the length of the displacer along the fluid conduit with constant stroke, a desired dosing volume, or similar to the above discussions, a desired dosing volume range can be adjusted.

Thus, the present invention provides a microdosing apparatus having a fluid conduit filled with a medium to be dosed, whose one end can be connected to a fluid reservoir and at whose other end an outlet opening is located, as well as an actuator by which the volume of a certain segment of the fluid conduit can be temporally changed, so that through the volume change, fluid is dispensed as free flying droplets or as free flying jet at the outlet opening. According to the invention, the whole fluid conduit can be formed by a flexible polymer tube. Alternatively, only the mentioned determined segment can be formed by a flexible polymer tube, while feed and drain from this segment are formed by a rigid fluid conduit.

As explained above, according to the invention, the displacement occurs at an elastic segment of the fluid conduit. Preferably, the elastic segment can resume the starting position in the fluid conduit, for example the flexible polymer tube or the membrane, respectively, after operation automatically, so that the displacer does not have to be connected to the fluid conduit in a fixed way, so that the fluid conduit can be designed as a simple disposable member.

The present invention also comprises drop generators, wherein several inventive microdosing apparatuses are disposed in parallel. Such microdosing apparatuses disposed in parallel can be controlled separately, to dose different liquids or the same liquids. Alternatively, the drop generator can have several fluid conduits, which can be controlled simultaneously by a displacer, so that the same or different liquids can be dosed by the same. For that purpose, the inlet ends of the different fluid conduits can be connected to the same or different liquid reservoirs.

Thus, an inventive microdosing apparatus can consist of one or several microdrop generators, each having a (elastic) fluidic conduit filled with a medium to be dosed, whose one end has an inlet opening connected to a fluid reservoir and whose other end has an outlet opening, wherein a pressure difference can exist between inlet opening and outlet opening, and an actuating device by which the volume of the conduit between fluid reservoir and outlet opening can be temporally changed, wherein during a first phase the fluidic volume between inlet opening and outlet opening is reduced with sufficient speed from its initial volume to a smaller volume, whereby a microdrop or a microjet, respectively, is ejected through the outlet opening and part of the displaced volume can leak out to the inlet opening, wherein the volume of the microdrop or microjet, respectively, plus the volume receding into the reservoir through the inlet opening substantially corresponds to the volume change caused by the actuating device, and in a second phase, wherein the volume between inlet opening and outlet opening is increased again, the fluid conduit is again filled from the reservoir driven by pressure or capillary forces.

Apart from the mount described with reference to FIGS. 2*a* to 2*d*, an automatic mount can be provided, which allows automatic adjustment of the position of the displacer to the fluid conduit, for example in response to a signal indicating a desired dosing volume range or a desired dosing volume, respectively.

By using the inventive microdosing apparatuses, thus, individual free flying microdroplets are generated preferably at an outlet opening in contact with the surrounding atmosphere, to dispense fluid as free flying droplets or free flying jet at the outlet opening. Thereby, the present invention allows ejecting of a droplet already with a single operating cycle of the actuating device, during which the displacer effects once a reduction of the volume of the fluid conduit to thereby eject the droplet.

The present invention allows adjusting the dosing volume by adjusting the stroke of the actuating device and/or disposing the actuating device at a predetermined position along the portion of a fluid conduit. Additionally, a displacer with adapted axial length can be chosen.

When using an adjustable stroke for adjusting the dosing volume, the stroke h of the actuating device or the displacer, respectively, is variable and smaller than the diameter of the tube, i.e. the cross section dimension of the same in the direction of the movement of the displacer of the actuating device.

In the case where the whole tube cross section is crimped, i.e. the flow area is substantially brought to zero, as required in DE 4314343 C2, the drop volume is determined by the extension of the hammer along the tube axis and by the tube diameter. By crimping the tube, the whole volume within the relevant tube portion is displaced. Approximately, for the displaced volume which then significantly determines the drop volume—with otherwise equal arrangement—the following applies:

$$V = \frac{a}{4} \cdot \pi d^2$$

Here, V represents the displaced volume, a the length of the displacer and d the diameter of the tube.

Compared with this, in a displacer with adjustable stroke, the stroke h around which the displacer is moved, plays a decisive role. Here, the displaced volume depends on the stroke h and can be approximately be described by the volume of a laterally trimmed cylinder:

$$V \approx \frac{d \cdot a}{24 \cdot h}\left(2\sqrt{\frac{(d-h)h}{d^2}}\,(3d^2 - 4d \cdot h + 4h^2) - 3d \cdot (d - 2h)Arcos\left(1 - \frac{2h}{d}\right)\right)$$

Here, h is the distance by which the tube is compressed.

By this dependence of the displaced volume V on stroke h and its described effect on the drop volume, the present invention allows a variable adjustment of the dosing volume without having to connect a tube with different diameter or a displacer with different dimensions, respectively.

According to the invention, there is a connection between volume displacement and drop generation or drop volume, respectively, in a single dosing process, so that the present invention allows dosing with a non-periodic excitation. This is advantageous, for example, when specific non-periodic patterns are to be printed on a substrate.

Figure 10A:
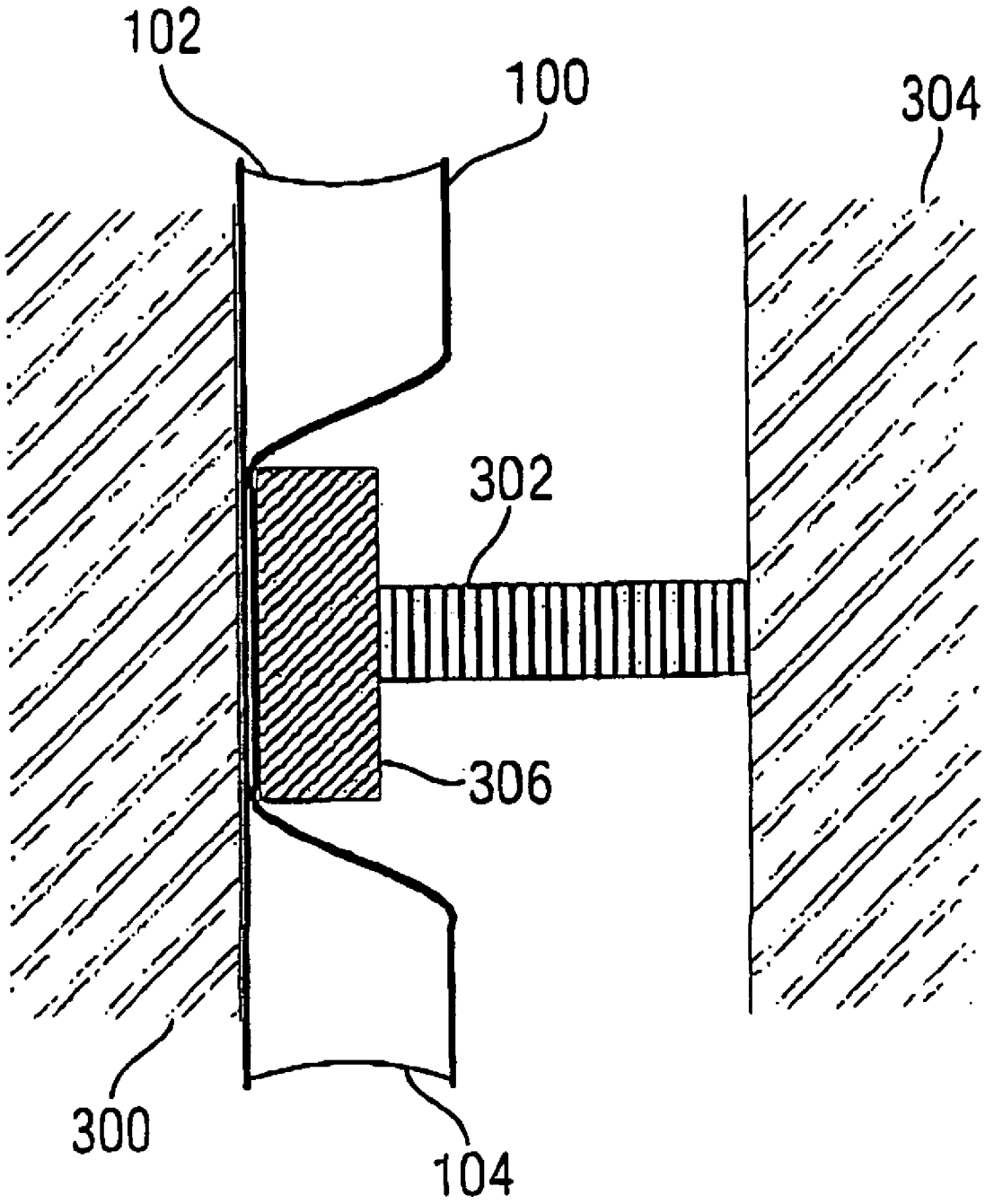
FIGS. 10*a*-10*b* are schematic representations of alternative embodiments of inventive microdosing apparatuses.

In the above-described embodiments, the actuating device is designed to effect an actuation of the tube starting from an uncrimped state of the same. Alternatively, embodiments are possible where the tube is partly or fully crimped, i.e. compressed, in standby mode. A schematic cross section representation of such an embodiment is shown in FIG. 10*a*. The tube 100 is applied to a counter mount 300 at its backside. On the opposing side of the tube 100, a piezoactuator 302 is mounted to a mount 302 of an actuating device. A displacer 306 is disposed at the front end of the piezoactuator 302.

In the arrangement shown in FIG. 10*a*, the tube 100 is fully crimped in the standby mode. The dosing cycle starts with slowly pulling back the piezoactuator 302, so that the cross section of the tube 100 is partly freed. During this phase, fluid flows from the reservoir, to which the tube 100 is connected at the end 102 opposing the outlet opening 104, in the previously crimped area, in order to compensate the increasing tube volume. The actual dosing process with the drop formation at the outlet end 104 is then performed by quickly extending the piezoactuator 302 to decrease the tube volume again. As in the above-described embodiments, the dosed volume is defined by the adjustment travel of the piezoactuator 302 and can thus be controlled by varying the operating voltage or by the variation of the charging current or discharge current at the piezoactuator 302, respectively. It is an advantage of the configuration shown in FIG. 10*a* that the crimped tube has a significantly lower evaporation rate of dosed material compared to the normally open tube.

Thus, this embodiment contains an integrated closing mechanism. However, it is a disadvantage that in commercially available conventional piezostack actuators the extended state of the piezoactuator is that state where the electric voltage is applied. When taking away the electric voltage, the piezostack actuator becomes shorter, the reduced state. Accordingly, this means that the embodiment of an integrated closing mechanism shown in FIG. 10*a* effects a continuous but slight energy consumption. In order to fully use the advantages of the integrated closing mechanism, it is advantageous in the embodiment shown in FIG. 10*a* to apply an electrical voltage continuously or to charge the piezoactuator, respectively, even when the dosing system is not used.

An integrated closing mechanism with reduced energy consumption can be implemented by providing the actuating device with a biasing means, for example a spring, pressing the displacer against the polymer tube in order to achieve partial or full crimping of the tube in the standby mode. Then, the actuating device preferably has an actuator, which is disposed to move the displacer against the force of the biasing means and to release the tube cross section partly or fully.

Figure 10B:
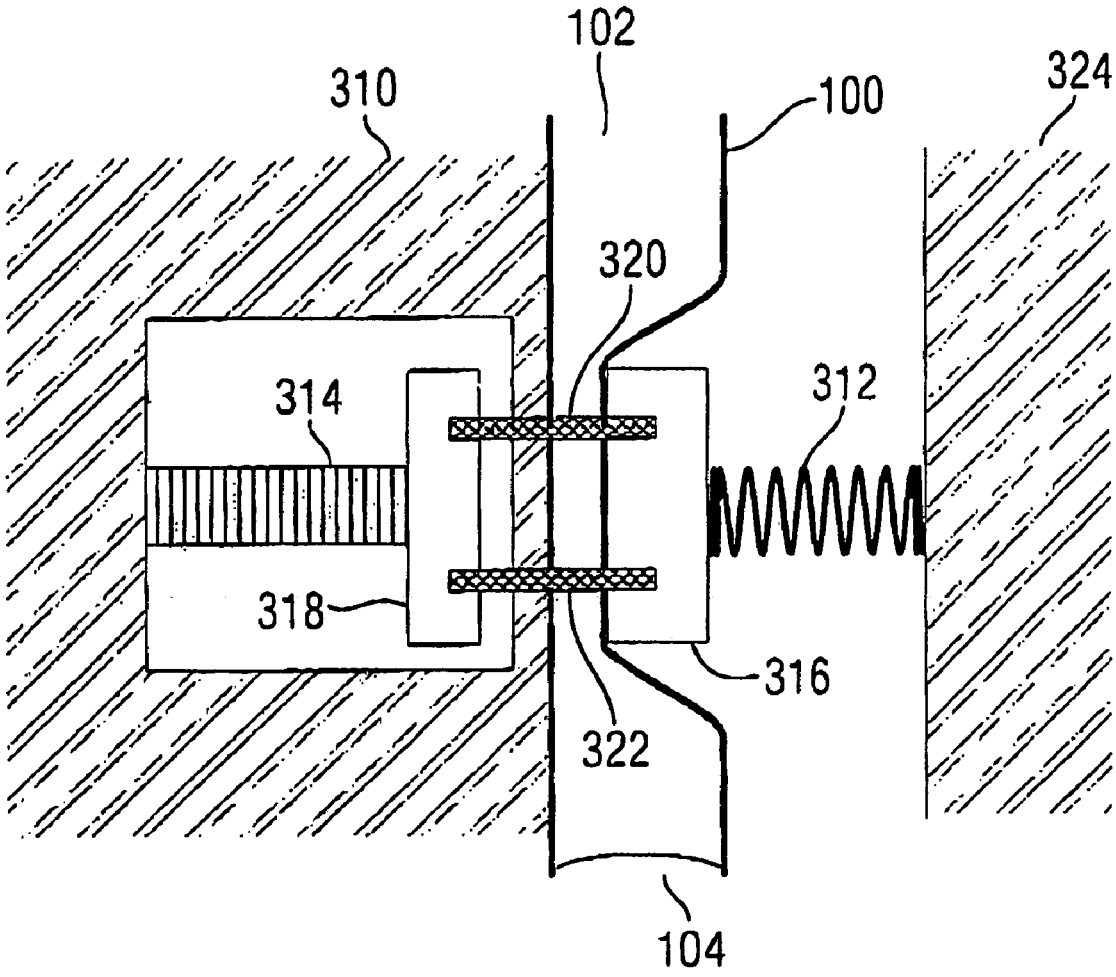

An embodiment for such an integrated closing mechanism is shown in FIG. 10*b*. Again, the tube 100 is applied against a counter mount 310. In this embodiment, an actuating device comprises a combination of a spring 312 and a piezostack actuator 314. Further, the actuating device comprises a displacer 316, which is rigidly coupled to an actuating plate 318. In FIG. 10*b*, two couplings rods 320 and 322 are shown as exemplary coupling means. The spring 312 is applied to a counter mount 324 at its right side end and presses the displacer 316 against tube 100 to crimp the same in the non-operated state of the actuator 314. This embodiment allows the realization of a dosing apparatus whose tube is crimped with switched off electrical supply voltage, so that the same has an integrated closing mechanism without continuous energy consumption.

In the switched off state, the displacer 316 is pressed on to the tube 100 by the spring such that the same is pressed onto the counter mount 310 and crimped. If a dosing process is to be performed, the piezoactuator 314 is extended by applying an electrical voltage, and thus the displacer 316 is reset against the spring force. The tube relaxes and the liquid to be dosed flows in from the reservoir connected to the side 102 of the tube opposed to the outlet opening 104. By quickly driving back the piezostack actuator 318, the tube 100 is again crimped via the spring 312, which is dimensioned in a sufficiently strong way. The spring is dimensioned rigidly enough so that liquid is dispensed from the outlet opening 104 as free flying jet. The dosed volume is again defined by the adjustment travel of the piezoactuator and can thus be controlled by varying the operating voltage or by varying the charging or discharge current in the piezostack actuator, respectively.

Here, it should be noted that embodiments discussed with regard to FIGS. 10*a* and 10*b* also function when the tube is not fully crimped.

In the embodiments of the present invention, where the dosing volume is adjusted via the adjustable stroke of the displacer or the actuating device, respectively, the displacer is moved between a first end position and the second end position, wherein the polymer tube is partly compressed in the first end position and the second end position. Thereby, the first end position defines a larger tube volume than the second end position, so that by moving the displacer from the first end position, into the second end position liquid is dosed out of the ejection end. Thereby, the first end position can define a fully relaxed state of the tube or a partly compressed state of the same. The second end position can comprise a partly compressed state or a fully compressed state of the polymer tube. In other words, in the inventive embodiments, where the dosing volume is adjustable by an adjustable stroke of the actuating device, the tube wall is moved by the actuating device or by the displacer, respectively, via a part of the light cross section of the flexible polymer tube. In contrary, when fully crimping the tube from a non-crimped state to a fully crimped state, the tube wall is moved across the whole light cross section of the tube.

The embodiments shown in FIGS. 10*a* and 10*b* can also be implemented such that the position of the actuating device can be varied to thereby be able to vary the dosing volume dispensed from the outlet opening.

While this invention has been described in terms of several preferred embodiments, there are alterations, permutations, and equivalents, which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

We claim:

1. A microdosing apparatus, comprising:

a fluid conduit having a flexible tube with a first end for connecting to a liquid reservoir and a second end where an outlet opening in contact with a surrounding atmosphere is located; and an actuating device having a displacer with adjustable stroke, by which the volume of a portion of the flexible tube is changed in an active area by moving the displacer between a first end position and a second end position, wherein the tube is partly compressed at least in the first end position or the second end position, the fluid conduit having no erratic cross section changes between the active area and the outlet opening in a resting state, the displacer being disposed relative to the outlet opening in such a manner that and the actuating device being configured to move the displacer in such a manner that, liquid is dispensed as free flying droplets or as free flying jet at the outlet opening, and the fluid conduit having such a cross sectional area that a liquid to be dosed can be moved through the fluid conduit by capillary forces.

2. The microdosing apparatus according to claim 1, wherein the flexible tube consists of polyimide.

3. The microdosing apparatus according to claim 1, wherein, by changing the position of the actuating device along the flexible tube, a ratio of a fluidic impedance between the position of the actuating device and the outlet opening to a fluidic impedance between the first end and the position of the actuating device is variable, so that the dosing volume output at the outlet opening is variable by at least 10%.

4. The microdosing apparatus according to claim 1, wherein the tube can be compressed across a predetermined length by the displacer in order to effect the volume change of the tube.

5. The microdosing apparatus according to claim 4, wherein the displacer has a form to effect an axially asymmetric volume change with regard to the tube.

6. The microdosing apparatus according to claim 1, further having a holder for holding the actuating device at a position along a portion of the tube.

7. The microdosing apparatus according to claim 1 having a biasing device to bias the tube into a fully or partly compressed state through the displacer.

8. The microdosing apparatus according to claim 7, wherein the actuating device has an actuator, which is disposed to move the displacer against the bias of the biasing device.

9. The microdosing apparatus according to claim 1, wherein the fluid conduit has a substantially constant cross section between the first end and the outlet opening in the resting position.

10. The microdosing apparatus according to claim 1, further having a provider for providing the fluid conduit with a pressure difference.

11. The microdosing apparatus according to claim 1, having a plurality of respective fluid conduits, so that several equal or different liquids can be dispensed simultaneously or successively.

12. The microdosing apparatus according to claim 11, having an actuating device for simultaneously effecting the volume change of the plurality of fluid conduits.

13. The microdosing apparatus according to claim 12, wherein the actuating device is a common displacer.

14. A method for dosed dispensing of liquids, comprising the steps of:

filling a fluid conduit having a flexible tube with a liquid to be dosed, the flexible tube having a first end for connecting to a liquid reservoir and a second end where an outlet opening in contact with a surrounding atmosphere is located and wherein the fluid conduit has no erratic cross section changes between an active area and the conduit opening in a resting state, effecting a volume change of a portion of the flexible tube in the active area by a displacer with adjustable stroke, by moving the displacer between a first end position and a second end position, wherein the tube is partly compressed at least in the first end position or the second end position, placing the displacer relative to the outlet opening in such a manner that and configuring the actuating device to move the displacer in such a manner that, liquid is dispensed as free flying droplets or as free flying jet at the outlet opening, and providing the fluid conduit with such a cross sectional area that a liquid to be dosed can be moved through the fluid conduit by capillary forces.

15. The method according to claim 14, further comprising the ste of providing a displacer at a position along the tube, by which the tube can be compressed across a predetermined length to effect the volume change of the portion of the same.

16. The method according to claim 15, wherein the fluid conduit has a first end connected to a fluid reservoir and a second end where the outlet opening is located, further comprising the step of:

selecting the position of the displacer along the tube to adjust a ratio of a fluidic impedance between the position of the displacer and the outlet opening to a fluidic impedance between the first end and the position of the actuating device, to thereby dispense a desired dosing volume at the outlet opening by effecting the volume change.

17. The method according to claim 15, further comprising a step of selecting a displacer with a length axial with regard to the flexible tube, to effect the volume change by using the displacer and to dispense a desired dosing volume at the outlet opening.

18. The method according to claim 16, wherein in the step of effecting the volume change, a volume change axially asymmetric with regard to the flexible tube is performed to effect a fluid flow with a preferred direction towards the outlet opening in the fluid conduit.

19. The method according to claim 14, further comprising a ste of providing the fluid conduit with a static pressure.

20. The method according to claim 19, wherein the static pressure with regard to the outlet end is an overpressure to effect a fluid flow with a preferred direction towards the outlet opening when effecting the volume change in the fluid conduit, and/or to support a refill after a dosing process.

21. The method according to claim 19, wherein the static pressure with regard to the outlet end is a subpressure to prevent leaking of liquid from the outlet end when no volume change is effected.

22. The method according to claim 14, further comprising a step of reversing the volume change after the step of effecting a volume change, so that the tube returns to the initial state, wherein during this step a capillary refill of the fluid conduit takes place.

* * * * *